US009922587B2

(12) United States Patent
Liu et al.

(10) Patent No.: US 9,922,587 B2
(45) Date of Patent: Mar. 20, 2018

(54) PIXEL STRUCTURE AND DRIVING METHOD THEREOF, DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Peng Liu, Beijing (CN); Chungchun Chen, Beijing (CN); Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 6 days.

(21) Appl. No.: 15/099,541

(22) Filed: Apr. 14, 2016

(65) Prior Publication Data

US 2017/0032726 A1 Feb. 2, 2017

(30) Foreign Application Priority Data

Jul. 28, 2015 (CN) ..... 2015 1 0451051

(51) Int. Cl.
*G09G 5/10* (2006.01)
*G09G 3/20* (2006.01)

(52) U.S. Cl.
CPC ... *G09G 3/2003* (2013.01); *G09G 2300/0452* (2013.01); *G09G 2320/0242* (2013.01);
(Continued)

(58) Field of Classification Search
CPC .. G09G 3/20; G09G 5/02; G09G 5/00; G09G 5/10
See application file for complete search history.

(56) References Cited

U.S. PATENT DOCUMENTS 9,343,511 B1 * 5/2016 Feng ..... H01L 27/3218
2012/0092238 A1 * 4/2012 Hwang ..... G09G 3/20 345/55
2013/0106891 A1 * 5/2013 Matsueda ..... G09G 3/2003 345/589

FOREIGN PATENT DOCUMENTS

CN 103886808 A 6/2014
CN 103886809 A 6/2014
(Continued)

OTHER PUBLICATIONS

First Office Action with English Translation, dated Mar. 10, 2017, CN Application No. 201510451051.0.

*Primary Examiner* — Pegeman Karimi
(74) *Attorney, Agent, or Firm* — Womble Bond Dickinson (US) LLP

(57) ABSTRACT

This disclosure provides a pixel structure and a driving method thereof, a display panel and a display device. The pixel structure comprises: a plurality of repeating groups; each repeating group comprising three sub-pixels of different colors arranged in row direction; positions of repeating groups of adjacent rows being staggered for one and a half sub-pixels in column direction. In the above pixel structure, three sub-pixels constitute two pixels, which can, under a relatively low physical resolution, realize a relatively high resolution through sharing sub-pixels by a plurality of pixel units.

12 Claims, 7 Drawing Sheets

(52) U.S. Cl.
CPC ..... *G09G 2330/021* (2013.01); *G09G 2340/0457* (2013.01)

(56) References Cited

FOREIGN PATENT DOCUMENTS

| | | | |
|---|---|---|---|
| CN | 103903549 | A | 7/2014 |
| CN | 104036710 | A | 9/2014 |
| CN | 104680948 | A | 6/2015 |
| JP | H08340455 | A | 12/1996 |

* cited by examiner

- - PRIOR ART - -

PIXEL STRUCTURE AND DRIVING METHOD THEREOF, DISPLAY PANEL AND DISPLAY DEVICE

FIELD OF THE INVENTION

This disclosure relates to the field of display technology, particularly to a pixel structure and a driving method thereof, a display panel and a display device.

BACKGROUND OF THE INVENTION

In the existing panel displays such as light emitting diode (LED), organic light emitting diode (OLED), plasma display panel (PDP) and liquid crystal display (LCD), as shown in FIG. 1, FIG. 1 is a structural schematic view of a pixel array in the prior art, provided with a plurality of sub-pixels with different color resistances arranged in a matrix. Generally speaking, three sub-pixels 01 of different color-resistance colors constitute one pixel 02 (represented by the bold block as shown in FIG. 1), wherein the three color-resistance colors are red (R), green (G) and blue (B). Or, four or more sub-pixels of different color-resistance colors constitute one pixel. When each pixel in the panel display comprises three sub-pixels of different color-resistance colors, within the display time of one frame, sub-pixels in each pixel are inputted with RGB signals, the panel display will display image according to the resolution determined by the size of the pixel.

At present, with the increasingly higher demand to the resolution of the panel display for displaying images, the size of the pixel is generally reduced to increase the resolution of the panel display for displaying images. However, with the size of the pixel getting smaller and smaller, it becomes more and more difficult to manufacture the panel display. Therefore, the resolution of the panel display for displaying images cannot be increased only by reducing the size of the pixels continuously, it is required to seek for a new approach of increasing the resolution of the panel display for displaying images.

Therefore, how to increase the resolution of the panel display for displaying images effectively is a technical problem that needs to be solved by the skilled person in the art urgently.

SUMMARY OF THE INVENTION

This disclosure provides a pixel structure and a driving method thereof, a display panel and a display device, for saving data lines and realizing a high resolution of the display device under the condition of low power consumption, so as to improve the display effect of the display device.

This disclosure provides a pixel structure, comprising: a plurality of repeating groups, each repeating group comprising three sub-pixels of different colors arranged in row direction; positions of repeating groups of adjacent rows being staggered for one and a half sub-pixels in column direction.

In the pixel structure provided by this disclosure, three sub-pixels constitute two pixels. In this way, a relatively high resolution can be realized through sharing sub-pixels by a plurality of pixel units under a relatively low physical resolution by making full use of the characteristics of human eyes on the spatial resolution. If a certain pixel position lacks sub-pixels of a certain color, the lacked color at this position can be simulated by lighting up the sub-pixels around it.

Moreover, compared with the pixel structure in the prior art, the pixel structure provided by this disclosure can save the number of the data lines.

In one embodiment, a ratio between a length of each sub-pixel in row direction and a length in column direction is 2:3.

In one embodiment, the three sub-pixels of different colors are respectively: a red sub-pixel, a green sub-pixel and a blue sub-pixel.

This disclosure further provides a driving method applied for said pixel structure, comprising:

receiving actual image information of a frame to be displayed;

dividing each actual pixel in a display panel into a plurality of virtual pixel units, to form virtual image information, wherein each of the virtual pixel units comprises one and a half sub-pixels in the actual image information;

determining a position of a virtual pixel unit where a sub-pixel to which the $s^{th}$ row and the $t^{th}$ column correspond locates in the virtual image information by taking one repeating group of the actual image information in row direction as one column;

determining a number n of the virtual pixel units in the virtual image information that need to be displayed through the sub-pixel to which the $s^{th}$ row and the $t^{th}$ column correspond in actual image information;

inputting a data signal value to the sub-pixel to which the $s^{th}$ row and the $t^{th}$ column correspond, when the number n=1, the input data signal value is one half of a preset input data signal value of the virtual pixel unit where the sub-pixel to which the $s^{th}$ row and the $t^{th}$ column correspond locates, when the number n>1, the input data signal value is an average value of preset input data signal values of n virtual pixel units that need to be displayed through the sub-pixel to which the $s^{th}$ row and the $t^{th}$ column correspond.

In the driving method provided by this disclosure, each actual pixel in a display panel is divided into a plurality of virtual pixel units, to form virtual image information; a position of a virtual pixel unit where a sub-pixel to which the $s^{th}$ row and the $t^{th}$ column correspond locates in the virtual image information is determined by taking one repeating group of the actual image information in row direction as one column; a number n of the virtual pixel units in the virtual image information that need to be displayed through the sub-pixel to which the $s^{th}$ row and the $t^{th}$ column correspond in actual image information is determined by performing classification discussion on the basic composition units of high-frequency image; and an input data signal value to the sub-pixel to which the $s^{th}$ row and the $t^{th}$ column correspond is determined through the number n, when the number n=1, the input data signal value is one half of a preset input data signal value of the virtual pixel unit where the sub-pixel to which the $s^{th}$ row and the $t^{th}$ column correspond locates, when the number n>1, the input data signal value is an average value of preset input data signal values of n virtual pixel units that need to be displayed through the sub-pixel to which the $s^{th}$ row and the $t^{th}$ column correspond. The area of the original pixels can be increased by sharing the sub-pixels, and the power consumption can be saved while realizing a relatively high resolution.

In one embodiment, the step of determining a position of a virtual pixel unit where a sub-pixel to which the $s^{th}$ row and the $t^{th}$ column correspond locates in the virtual image information comprises:

determining a position of the virtual pixel unit based on formula 1=s, m=2t−1, wherein 1 is the number of row where the virtual pixel unit locates, m is the number of column where the virtual pixel unit locates.

This disclosure further provides a display panel, comprising: a pixel structure as stated in any of the above. Since the above pixel structure can save the number of the data lines, the display panel provided by this disclosure has the advantage of low power consumption.

This disclosure further provides a display device, comprising: the above display panel, further comprising:

a receiving unit for receiving actual image information of a frame to be displayed;

a pixel dividing unit for dividing each actual pixel in a display panel into a plurality of virtual pixel units, to form virtual image information, wherein each of the virtual pixel units comprises one and a half sub-pixels in the actual image information;

a first determining unit for determining a position of a virtual pixel unit where a sub-pixel to which the $s^{th}$ row and the $t^{th}$ column correspond locates in the virtual image information by taking one repeating group of the actual image information in row direction as one column;

a second determining unit for determining a number n of the virtual pixel units in the virtual image information that need to be displayed through the sub-pixel to which the $s^{th}$ row and the $t^{th}$ column correspond in actual image information;

a processing unit for inputting a data signal value to the sub-pixel to which the $s^{th}$ row and the $t^{th}$ column correspond, when the number n=1, the input data signal value is one half of a preset input data signal value of the virtual pixel unit where the sub-pixel to which the $s^{th}$ row and the $t^{th}$ column correspond locates, when the number n>1, the input data signal value is an average value of preset input data signal values of n virtual pixel units that need to be displayed through the sub-pixel to which the $s^{th}$ row and the $t^{th}$ column correspond.

In one embodiment, the second determining unit is used for:

determining a position of the virtual pixel unit based on formula 1=s, m=2t−1, wherein 1 is the number of row where the virtual pixel unit locates, m is the number of column where the virtual pixel unit locates.

| Reference signs: | |
|---|---|
| 01-sub-pixel | 02-pixel |
| 1-sub-pixel | 2-virtual pixel unit |
| 3-receiving unit | 4-pixel dividing unit |
| 5-first determining unit | 6-second determining unit |
| 7-processing unit | |

DETAILED DESCRIPTION OF THE INVENTION

Next, the technical solutions in the embodiments of this disclosure will be described clearly and completely with reference to the drawings. Apparently, the embodiments described are only a part of rather than all of the embodiments of this disclosure.

Figure 1:
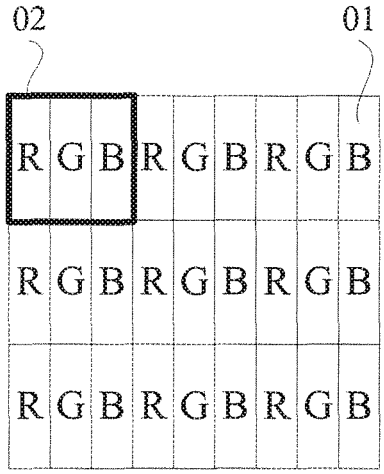
FIG. 1 is a structural schematic view of a pixel array in the prior art.
Figure 2:
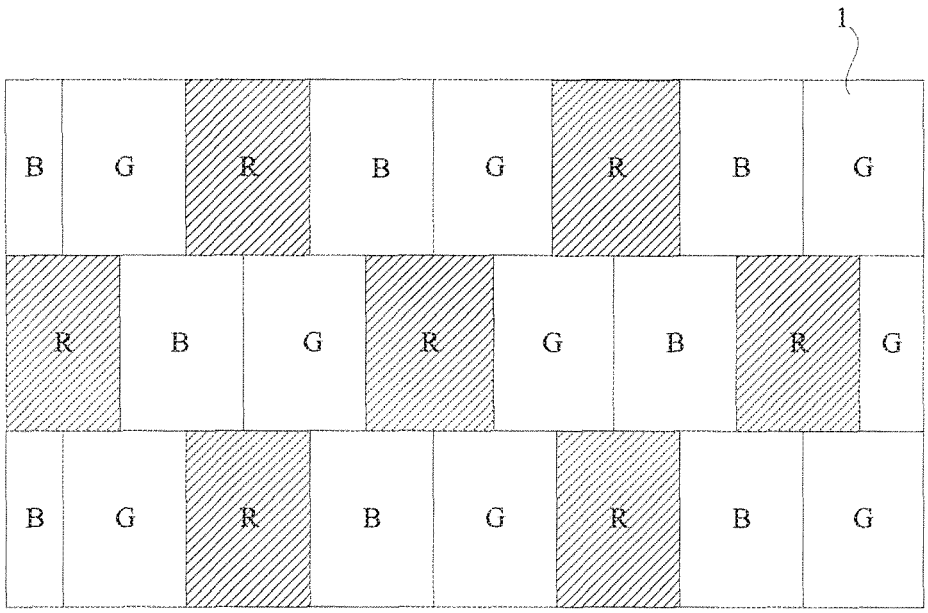
FIG. 2 is a structural schematic view of a pixel array provided by this disclosure.

As shown in FIG. 2, FIG. 2 is a structural schematic view of a pixel array provided by this disclosure. The pixel structure comprises: a plurality of repeating groups, each repeating group comprising three sub-pixels 1 of different colors arranged in row direction; positions of repeating groups of adjacent rows being staggered for one and a half sub-pixels 1 in column direction.

In the pixel structure provided by this disclosure, three sub-pixels constitute two pixels. In this way, a relatively high resolution can be realized through sharing sub-pixels 1 by a plurality of pixel units under a relatively low physical resolution by making full use of the characteristics of human eyes on the spatial resolution. If a certain pixel position lacks sub-pixels of a certain color, the lacked color at this position can be simulated by lighting up the sub-pixels around it. Moreover, compared with the pixel structure in the prior art, the pixel structure provided by this disclosure can save the number of the data lines.

A ratio between a length of each sub-pixel in row direction and a length in column direction can be 2:3.

The above three sub-pixels of different color can be respectively: a red sub-pixel, a green sub-pixel and a blue sub-pixel. Specifically, in any two adjacent rows of repeating groups:

The first row of sub-pixels are red sub-pixel, blue sub-pixel and green sub-pixel successively, the second row of sub-pixels are green sub-pixel, red sub-pixel and blue sub-pixel successively; or The first row of sub-pixels are blue sub-pixel, red sub-pixel and green sub-pixel successively, the second row of sub-pixels are green sub-pixel, blue sub-pixel and red sub-pixel successively; or The first row of sub-pixels are blue sub-pixel, green sub-pixel and red sub-pixel successively, the second row of sub-pixels are red sub-pixel, blue sub-pixel and green sub-pixel successively; or The first row of sub-pixel are green sub-pixel, blue sub-pixel and red sub-pixel successively, the second row of sub-pixels are red sub-pixel, green sub-pixel and blue sub-pixel successively; or The first row of sub-pixels are green sub-pixel, red sub-pixel and blue sub-pixel successively, the second row of sub-pixels are blue sub-pixel, green sub-pixel and red sub-pixel successively; or The first row of sub-pixel are red sub-pixel, green sub-pixel and blue sub-pixel successively, the second row of sub-pixels are blue sub-pixel, red sub-pixel and green sub-pixel successively.

Figure 3:
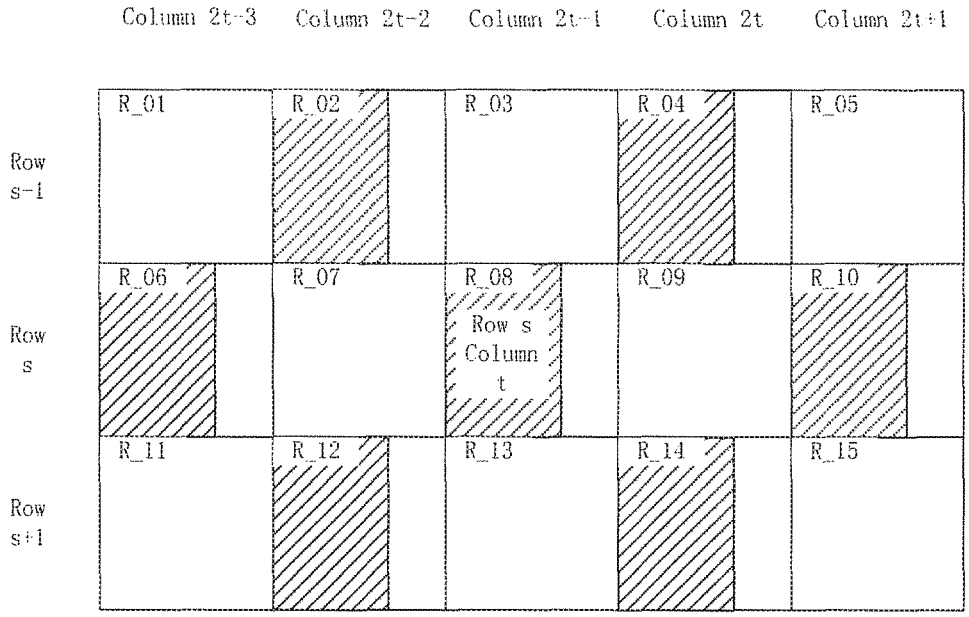
FIG. 3 is a structural schematic view of a virtual pixel unit provided by this disclosure.
Figure 4:
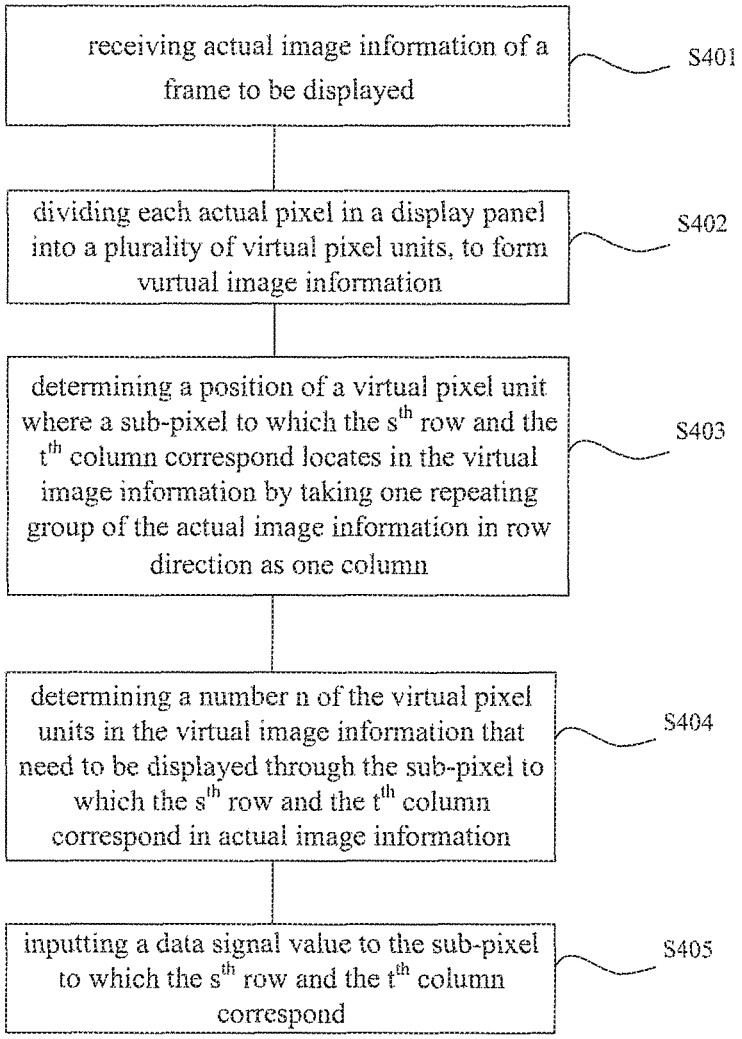
FIG. 4 is a flow chart of a driving method provided by this disclosure.
Figure 5A:
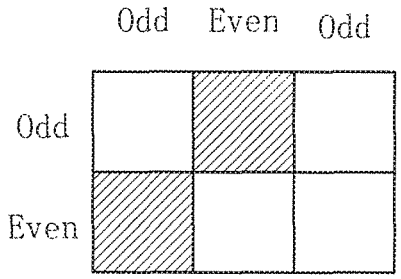
FIGS. 5*a*-5*l* are basic graphic units.
Figure 5B:
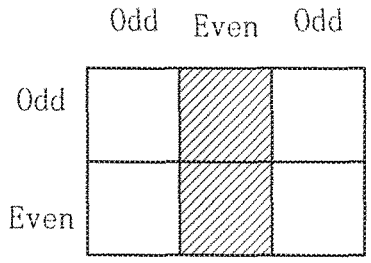
Figure 5C:
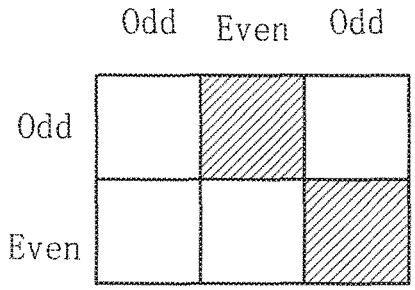
Figure 5D:
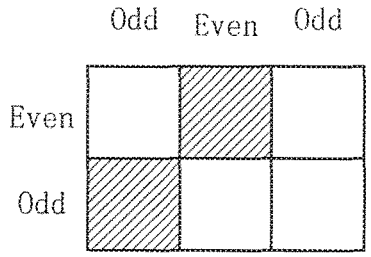
Figure 5E:
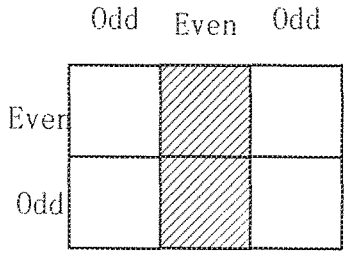
Figure 5F:
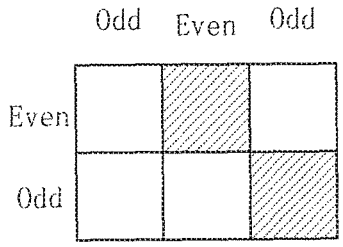
Figure 5G:
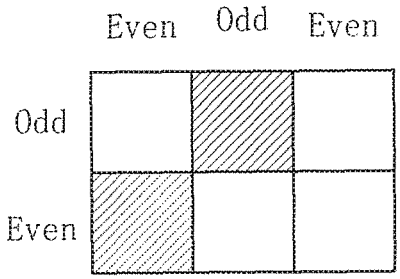
Figure 5H:
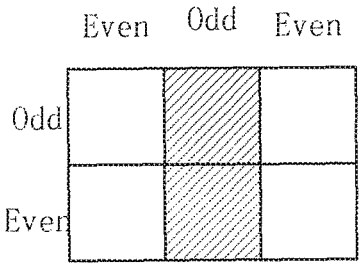
Figure 5I:
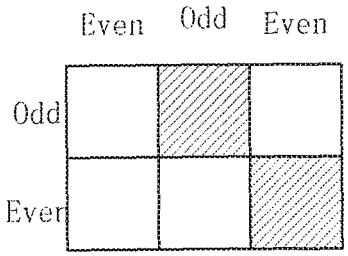
Figure 5J:
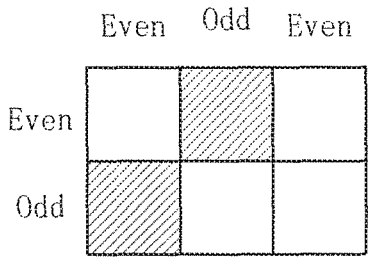
Figure 5K:
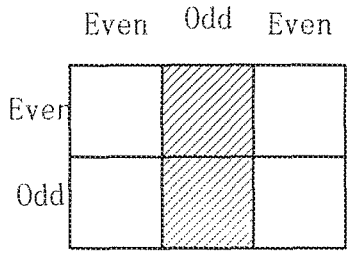
Figure 5L:
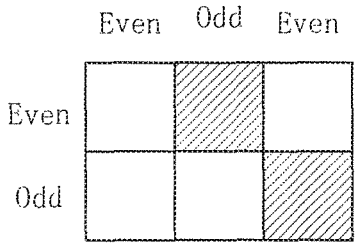

As shown in FIG. 3 and FIG. 4, wherein: FIG. 3 is a structural schematic view of a virtual pixel unit provided by this disclosure; FIG. 4 is a flow chart of a driving method provided by this disclosure. The driving method applied for the above pixel structure provided by this disclosure comprises:

Step S401: receiving actual image information of a frame to be displayed;

Step S402: dividing each actual pixel in a display panel into a plurality of virtual pixel units 2 (as shown in FIG. 3), to form virtual image information, wherein each of the virtual pixel units 2 comprises one and a half sub-pixels in the actual image information;

Step S403: determining a position of a virtual pixel unit where a sub-pixel to which the $s^{th}$ row and the $t^{th}$ column correspond locates in the virtual image information by taking one repeating group of the actual image information in row direction as one column;

Step S404: determining a number n of the virtual pixel units in the virtual image information that need to be displayed through the sub-pixel to which the $s^{th}$ row and the $t^{th}$ column correspond in actual image information;

Step S405: inputting a data signal value to the sub-pixel to which the sib row and the $t^{th}$ column correspond, when the number n=1, the input data signal value is one half of a preset input data signal value of the virtual pixel unit where the sub-pixel to which the $s^{th}$ row and the $t^{th}$ column correspond locates, when the number n>1, the input data signal value is an average value of preset input data signal values of n virtual pixel units that need to be displayed through the sub-pixel to which the $s^{th}$ row and the $t^{th}$ column correspond.

As shown in FIGS. 5*a*-5*l*, wherein: FIGS. 5*a*-5*l* are basic graphic units. In this disclosure an image is divided into a plurality of basic graphic units, the basic graphic units are classified into three types in terms of shape: vertical line, left oblique line, right oblique line, and classified into four types in terms of position: odd row-odd column, odd row-even column, even row-odd column, even row-even column.

In the driving method provided by this disclosure, each actual pixel in a display panel is divided into a plurality of virtual pixel units, to form virtual image information; a position of a virtual pixel unit where a sub-pixel to which the $s^{th}$ row and the $t^{th}$ column correspond locates in the virtual image information is determined by taking one repeating group of the actual image information in row direction as one column; a number n of the virtual pixel units in the virtual image information that need to be displayed through the sub-pixel to which the $s^{th}$ row and the $t^{th}$ column correspond in actual image information is determined by performing classification discussion on the basic composition units of high-frequency image; and an input data signal value to the sub-pixel to which the $s^{th}$ row and the $t^{th}$ column correspond is determined through the number n, when the number n=1, the input data signal value is one half of a preset input data signal value of the virtual pixel unit where the sub-pixel to which the $s^{th}$ row and the $t^{th}$ column correspond locates, when the number n>1, the input data signal value is an average value of preset input data signal values of n virtual pixel units that need to be displayed through the sub-pixel to which the $s^{th}$ row and the $t^{th}$ column correspond. The area of the original pixels can be increased by sharing the sub-pixels, and the power consumption can be saved while realizing a relatively high resolution.

Further, the step S403 of determining a position of a virtual pixel unit where a sub-pixel to which the $s^{th}$ row and the $t^{th}$ column correspond locates in the virtual image information comprises:

determining a position of the virtual pixel unit based on formula 1=s, m=2t−1, wherein 1 is the number of row where the virtual pixel unit locates, m is the number of column where the virtual pixel unit locates.

FIG. 3 gives the corresponding relationship between the actual pixel that takes the $s^{th}$ row and the $t^{th}$ column as the center and the virtual pixel unit by taking the red sub-pixel as an example. The square areas are virtual pixel units, the corresponding serial numbers are R_01, R_02 . . . R_15, the oblique line background areas are actual pixel positions. The position of the virtual pixel unit where the sub-pixel to which the $s^{th}$ row and the $t^{th}$ column in the actual image information correspond locates in the virtual image information is the $s^{th}$ row and the $2t-1^{th}$ column.

The position to which the virtual pixel unit R_08 corresponds has an actual pixel, i.e., row s column t (s, t), the positions to which the virtual pixel units R_03, R_07, R_09, R_13 around it correspond have no actual pixels, hence, the data in R_03, R_07, R_09, R_13 have to borrow the actual pixel (s, t) at the position of R_08 for display.

When traverse to row s column t, the three rows and five columns of virtual pixel units taking the actual pixel (s, t) as the center are identified to obtain the number n of the virtual pixel units that need to be displayed through the actual pixel (s, t). If n=1, the input data signal value of the sub-pixel to which the $s^{th}$ row and the $t^{th}$ column correspond is one half of a preset input data signal value of the virtual pixel unit where the sub-pixel to which the $s^{th}$ row and the $t^{th}$ column correspond locates. If n>1, the input data signal value of the sub-pixel to which the $s^{th}$ row and the $t^{th}$ column correspond is an average value of preset input data signal values of n virtual pixel units that need to be displayed through the sub-pixel to which the $s^{th}$ row and the $t^{th}$ column correspond. After the processing is finished, traverse to row s column t+1.

This disclosure further provides a display panel, comprising: a pixel structure as stated in any of the above. Since the above pixel structure can save the number of the data lines, the display panel provided by this disclosure has the advantage of low power consumption.

Figure 6:
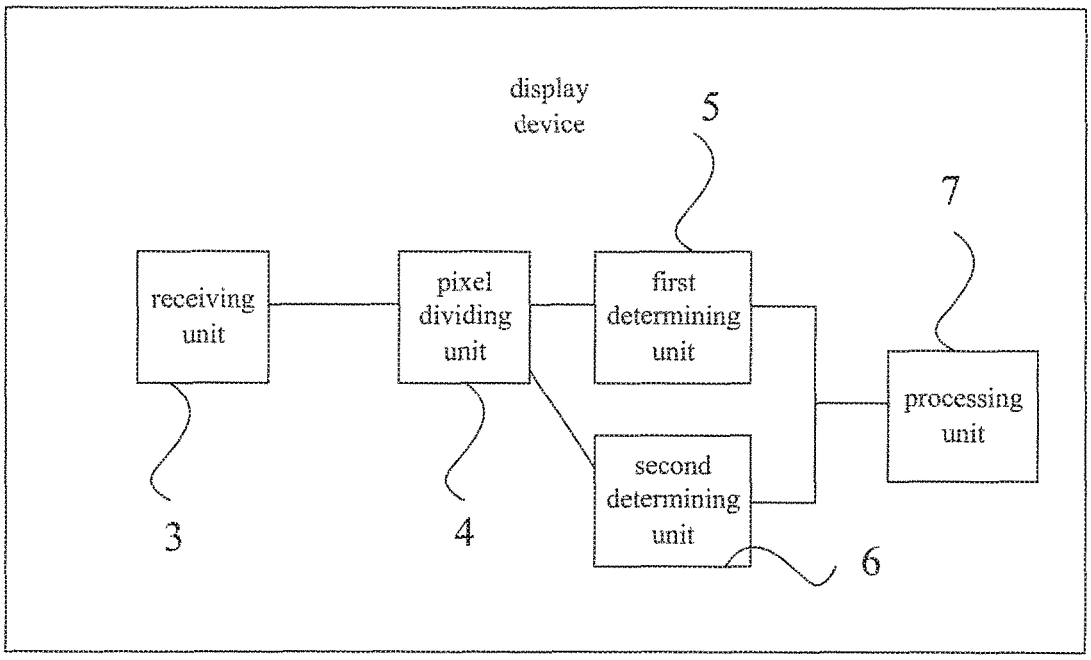
FIG. 6 is a structural schematic view of a display device provided by this disclosure.

As shown in FIG. 6, FIG. 6 is a structural schematic view of a display device provided by this disclosure. This disclosure provides a display device, comprising: the above display panel, further comprising:

a receiving unit 3 for receiving actual image information of a frame to be displayed;

a pixel dividing unit 4 for dividing each actual pixel in a display panel into a plurality of virtual pixel units, to form virtual image information, wherein each of the virtual pixel units comprises one and a half sub-pixels in the actual image information;

a first determining unit 5 for determining a position of a virtual pixel unit where a sub-pixel to which the $s^{th}$ row and the $t^{th}$ column correspond locates in the virtual image information by taking one repeating group of the actual image information in row direction as one column;

a second determining unit 6 for determining a number n of the virtual pixel units in the virtual image information that need to be displayed through the sub-pixel to which the $s^{th}$ row and the $t^{th}$ column correspond in actual image information;

a processing unit 7 for inputting a data signal value to the sub-pixel to which the $s^{th}$ row and the $t^{th}$ column correspond, when the number n=1, the input data signal value is one half of a preset input data signal value of the virtual pixel unit where the sub-pixel to which the $s^{th}$ row and the $t^{th}$ column correspond locates, when the number n>1, the input data signal value is an average value of preset input data signal values of n virtual pixel units that need to be displayed through the sub-pixel to which the $s^{th}$ row and the $t^{th}$ column correspond.

Further, the second determining unit 6 is used for:

determining a position of the virtual pixel unit based on formula 1=s, m=2t−1, wherein 1 is the number of row where the virtual pixel unit locates, m is the number of column where the virtual pixel unit locates.

Apparently, the skilled person in the art can make various modifications and variations to the embodiments in this disclosure without departing from the spirit and the scope of this disclosure. In this way, provided that these modifications and variations of this disclosure belong to the scopes of the claims of this disclosure and the equivalent technologies thereof, this disclosure also intends to cover these modifications and variations.

The invention claimed is:

1. A driving method of a pixel structure, wherein the pixel structure comprises a plurality of repeating groups, each repeating group comprising three sub-pixels of different colors arranged in row direction, and positions of repeating groups of adjacent rows being staggered for one and a half sub-pixels in column direction, the driving method comprising:

receiving actual image information of a frame to be displayed;

dividing each actual pixel in a display panel into a plurality of virtual pixel units, to form virtual image information, wherein each of the virtual pixel units comprises one and a half sub-pixels in the actual image information;

determining a position of a virtual pixel unit where a sub-pixel to which the $s^{th}$ row and the $t^{th}$ column correspond locates in the virtual image information by taking one repeating group of the actual image information in row direction as one column;

determining a number n of the virtual pixel units in the virtual image information that need to be displayed through the sub-pixel to which the $s^{th}$ row and the $t^{th}$ column correspond in actual image information;

inputting a data signal value to the sub-pixel to which the $s^{th}$ row and the $t^{th}$ column correspond, when the number n=1, the input data signal value is one half of a preset input data signal value of the virtual pixel unit where the sub-pixel to which the $s^{th}$ row and the $t^{th}$ column correspond locates, when the number n>1, the input data signal value is an average value of preset input data signal values of n virtual pixel units that need to be displayed through the sub-pixel to which the $s^{th}$ row and the $t^{th}$ column correspond.

2. The driving method of a pixel structure as claimed in claim 1, wherein a ratio between a length of each sub-pixel in row direction and a length in column direction is 2:3.

3. The driving method of a pixel structure as claimed in claim 2, wherein the three sub-pixels of different colors are respectively: a red sub-pixel, a green sub-pixel and a blue sub-pixel.

4. The driving method of a pixel structure as claimed in claim 1, wherein the step of determining a position of a virtual pixel unit where a sub-pixel to which the $s^{th}$ row and the $t^{th}$ column correspond locates in the virtual image information comprises:

determining a position of the virtual pixel unit based on formula 1=s, m=2t−1, wherein 1 is the number of row where the virtual pixel unit locates, m is the number of column where the virtual pixel unit locates.

5. The driving method of a pixel structure as claimed in claim 4, wherein a ratio between a length of each sub-pixel in row direction and a length in column direction is 2:3.

6. The driving method of a pixel structure as claimed in claim 5, wherein the three sub-pixels of different colors are respectively: a red sub-pixel, a green sub-pixel and a blue sub-pixel.

7. A display device, comprising a display panel, wherein the display panel comprises a pixel structure, the pixel structure comprises a plurality of repeating groups, each repeating group comprising three sub-pixels of different colors arranged in row direction, and positions of repeating groups of adjacent rows being staggered for one and a half sub-pixels in column direction, the display device further comprising:

a receiving unit for receiving actual image information of a frame to be displayed;

a pixel dividing unit for dividing each actual pixel in a display panel into a plurality of virtual pixel units, to form virtual image information, wherein each of the virtual pixel units comprises one and a half sub-pixels in the actual image information;

a first determining unit for determining a position of a virtual pixel unit where a sub-pixel to which the $s^{th}$ row and the $t^{th}$ column correspond locates in the virtual image information by taking one repeating group of the actual image information in row direction as one column;

a second determining unit for determining a number n of the virtual pixel units in the virtual image information that need to be displayed through the sub-pixel to which the $s^{th}$ row and the $t^{th}$ column correspond in actual image information;

a processing unit for inputting a data signal value to the sub-pixel to which the $s^{th}$ row and the $t^{th}$ column correspond, when the number n=1, the input data signal value is one half of a preset input data signal value of the virtual pixel unit where the sub-pixel to which the $s^{th}$ row and the $t^{th}$ column correspond locates, when the number n>1, the input data signal value is an average value of preset input data signal values of n virtual pixel units that need to be displayed through the sub-pixel to which the $s^{th}$ row and the $t^{th}$ column correspond.

8. The display device as claimed in claim 7, wherein a ratio between a length of each sub-pixel in row direction and a length in column direction is 2:3.

9. The display device as claimed in claim 8, wherein the three sub-pixels of different colors are respectively: a red sub-pixel, a green sub-pixel and a blue sub-pixel.

10. The display device as claimed in claim 7, wherein the second determining unit is used for:

determining a position of the virtual pixel unit based on formula 1=s, m=2t−1, wherein 1 is the number of row where the virtual pixel unit locates, m is the number of column where the virtual pixel unit locates.

11. The display device as claimed in claim 10, wherein a ratio between a length of each sub-pixel in row direction and a length in column direction is 2:3.

12. The display device as claimed in claim 11, wherein the three sub-pixels of different colors are respectively: a red sub-pixel, a green sub-pixel and a blue sub-pixel.

* * * * *